United States Patent [19]

Hardt

[11] 4,211,166

[45] Jul. 8, 1980

[54] PRINT BAND ONE EDGE GUIDE

[75] Inventor: Thomas T. Hardt, Mount Clemens, Mich.

[73] Assignee: Computer Peripherals, Inc., Minneapolis, Minn.

[21] Appl. No.: 939,154

[22] Filed: Sep. 1, 1978

Related U.S. Application Data

[63] Continuation of Ser. No. 799,843, May 23, 1977, abandoned.

[51] Int. Cl.[3] ..... B41J 1/20

[52] U.S. Cl. ..... 101/111; 101/93.14; 198/840

[58] Field of Search ..... 101/111, 93.14, 105; 74/240, 241; 198/800, 840, 841

[56] References Cited

U.S. PATENT DOCUMENTS

| | | | |
|---|---|---|---|
| 3,621,778 | 11/1971 | Ripple et al. | 101/111 X |
| 3,633,500 | 1/1972 | Edwards et al. | 101/111 |
| 3,805,698 | 4/1974 | Bowers et al. | 101/93.14 X |
| 3,987,723 | 10/1976 | Mahoney et al. | 101/93.14 X |

OTHER PUBLICATIONS

Iobst et al., IBM Tech. Disclosure Bulletin, vol. 15, No. 4, Sep. 1972, p. 1234.

Bonnfino, IBM Tech. Disclosure Bulletin, vol. 15, No. 2, Jul., 1973, p. 603.

*Primary Examiner*—Edward M. Coven

*Attorney, Agent, or Firm*—Robert M. Angus; George J. Muckenthaler; Wilbert Hawk, Jr.

[57] ABSTRACT

A plurality of print hammers disposed along a print station are caused to be swung against a print band and there is provided a top edge guide to limit upward movement of the band and maintain the print band in a precise path in its travel past the print station. The print band is trained around pulleys which are biased upwardly by light springs to maintain the band in contact with the top edge guide.

9 Claims, 4 Drawing Figures

PRINT BAND ONE EDGE GUIDE

This is a continuation of application Ser. No. 799,843, filed May 23, 1977 now abandoned.

BACKGROUND OF THE INVENTION

In the field of high speed printers, the drum printer has proved to be very successful in providing a rotating surface against which print hammers impact the characters carried on such surface. However, the need for a reduction in weight along with compactness in size and decrease in cost has brought about the endless print band or belt which carries integral type characters in a line along the print station and past the print hammers. Such print hammers are constructed in a bank which includes hammer drive solenoids for causing the hammers to be driven against the type characters on the band in a sequence dictated by the desired printing program.

The print band is trained around a drive pulley and a driven or idler pulley normally in a horizontal manner, such pulleys being crowned to provide a tracking surface for the band. Provisions may also be made in the supporting structure for the pulleys to permit rapid changing of print bands while at the same time maintaining proper tension on the band during operation.

Various ways and means have been utilized in the past for maintaining a print belt, chain, band, or the like in a precise path past the print station so as to prevent the type characters thereon from moving in vertical displacement from the line of print hammers.

Representative prior art relating to the subject matters of the present invention is disclosed in U.S. Pat. No. 3,012,499, as issued on Dec. 12, 1961 to S. Amada, wherein a high speed printing system has a type belt with printing type thereon and a guide is provided with upper and lower portions to fit over the edges of the belt for suppressing vibration and shifting of the type belt and a central portion is provided to receive the force of the printing type.

U.S. Pat. No. 3,216,348, issued on Nov. 9, 1965 to K. F. Oldenburg et al., discloses hammer timing means in a high speed belt printer having a belt with hammers and a sprocket for driving the belt. The belt is guided along a channel shaped guideway and includes flanges which overlap the edges of the belt so as to maintain such belt in contact with the guideway as it is advanced past the hammers.

U.S. Pat. No. 3,224,366, issued on Dec. 21, 1965 to J. M. Cunningham, discloses a type carrier device which includes a stationary guide member taking the form of a monorail attached to a support plate and having parallel spaced-apart straight portions connected at opposite ends by curved portions to form a continuous closed guide path for the type elements.

U.S. Pat. No. 3,402,657, which issued on Sept. 24, 1968 to J. T. Potter et al., discloses a high speed belt printer with printing slug supporting means wherein a print chain is established by a plurality of integrally casted printing slugs clipped about the edges of an elastic timing belt. The print chain is supported relative to the print hammers by a frame featuring a modular or sub-assembly construction in which the basic components are formed from a length of precision stock of the same cross-section.

U.S. Pat. No. 3,745,918, which issued on July 17, 1973 to F. J. Perry et al., discloses U-shaped type carriers with legs of increasing width which overlap the legs of adjacent carriers to provide stability and close spacing of the type characters, and provides for upper and lower guide members having inturned lip portions which engage each type carrier to maintain same in operating alignment along a printing line.

U. S. Pat. No. 3,805,697, issued on Apr. 23, 1974 to J. A. Mahe, discloses a cartridge for a print character band which includes a pair of magnetic strips to maintain the print band against a portion of the inner wall of the cartridge cover.

U.S. Pat. No. 3,805,698, issued on Apr. 23, 1974 to G. W. Bowers, Jr. et al., discloses a print carrier and transport cartridge which has an endless print band or belt with guide means formed by a V-shaped ridge around the belt. The cartridge includes a housing having a side wall which includes a recessed portion that cooperates with the ridge of the print bet as it passes the hammer assembly, thereby restraining the print characters from moving in an upward or downward direction.

U.S. Pat. No. 3,972,282, issued on Aug. 3, 1976 to J. Konkel, discloses a type train assembly having a pair of endless belts, type carriers with type blocks, and a guide mounted on a support with the guide having a slot for the blocks. A carrier guide bar is also mounted on the support to hold the type blocks in position and to provide rigid support for the type faces when struck by the hammers.

And U.S. Pat. No. 3,630,144, which issued on Dec. 28, 1971 to F. Hilpert et al., discloses a toothed belt with type carriers thereon maintained along a print line by means of a C-shaped type carrier guide within the printer station and opposite the printer hammers provided.

SUMMARY OF THE INVENTION

The present invention relates to band printers and more particularly to guide means for an endless band which contains type characters along the circumferential surface thereof. The print band is trained around a drive pulley and an idler pulley, such pulleys being biased in an upwardly direction to maintain the print band in a precise path along a line of print hammers. A platen member is disposed between the drive pulley and the idler pulley and along which platen the print band travels to a position where printing is performed in a line at a time by the print hammers. The print hammers are downwardly disposed and swingable about a common axis and upon actuation of the print hammers, the face of the hammer is caused to be swung in an arc against the characters on the print band. Since the swinging of the print hammers is in an upward arc and thus results in an upward force being directed against the print band, means must be provided to maintain the print band in a precise path and along a desired printing line with the platen. To this end a top edge guide is secured to the platen to provide a surface against which the upper edge of the print band is biased continuously in contact to maintain the print band in such precise path and to prevent the print band from moving vertically away from the line of printing.

In accordance with the above discussion, the principal object of the present invention is to provide means for maintaining the print band in the desired path of travel.

Another object of the present invention is to provide a stationary guide member continuously engaging and maintaining the print band along a precise path past associated print hammers.

An additional object of the present invention is to provide means for preventing vertical movement of the print band during impact of the print hammers therewith.

A further object of the present invention is to provide a top edge guide to prevent upward vertical motion of the print band along the line of printing which results from a lifting force being transmitted to the print band by the print hammers upon impact therewith.

Additional advantages and features of the present invention will become apparent and fully understood from a reading of the following description taken together with the annexed drawing in which.

Figure 1:
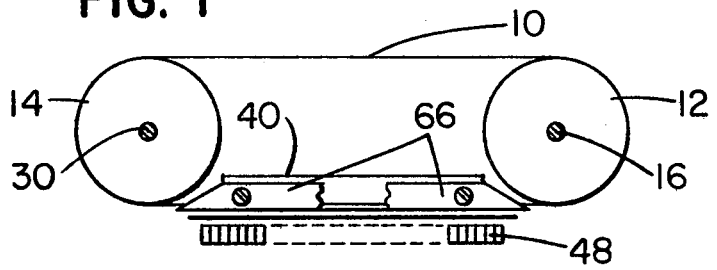
FIG. 1 is a diagrammatic plan view of the print band trained around the support pulleys and along a line of printing.
Figure 2:
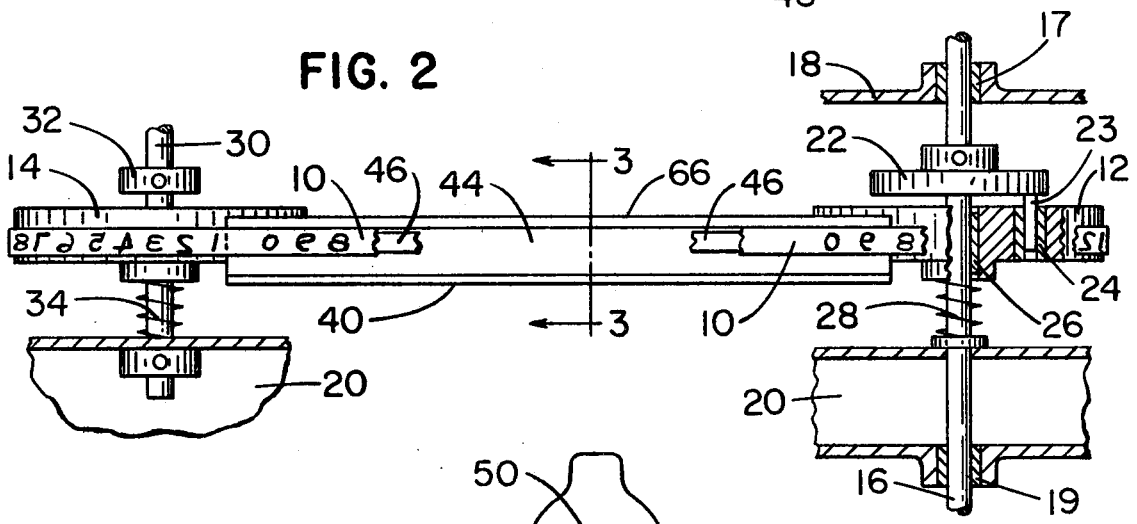
FIG. 2 is an elevational view of the pulleys and the supports therefor.

As mentioned previously, a printer which utilizes and incorporates the subject matter of the present invention includes a print band which carries a plurality of type characters thereon. Such band printer distinguishes from a drum printer in a number of areas and features, the most significant area being the type character carrying structure. As illustrated in FIG. 1, a print band 10 is trained around a drive pulley 12 and a driven or idler pulley 14. Such drive pulley 12 is driven by suitable means which, as illustrated in FIG. 2, includes a drive shaft 16 journaled in bearings 17 and 19 supported from respective upper and lower printer framework 18 and 20. Although not illustrated, such drive shaft 16 is suitably connected to a drive motor for continuous rotation during operation of the printer. A flywheel 22 (FIG. 2) is secured to the shaft 16 at a precise distance above the lower framework 20 and includes a downwardly extending drive pin 23 which slidingly engages a connecting bushing 24 carried by the drive pulley 12—such pulley 12 itself being supported on the drive shaft 16 by a linear bearing 26 permitting sliding movement thereof along the shaft 16 between the printer lower framework 20 and the flywheel 22. A medium to light weight coil spring 28 encircles the drive shaft 16 immediately above the framework 20 and is of that length to continually urge the drive pulley 12 upwardly toward engagement with the flywheel 22.

The driven or idler pulley 14 likewise includes a linear bearing (not shown) permitting rotation and sliding movement thereof along a support shaft 30 secured to the printer lower framework 20. An upper collar 32 is secured to such shaft 30 in approximate horizontal alignment with the flywheel 22 and an encircling coil spring 34 identical to spring 28 continually urges the idler pulley 14 upwardly toward engagement with the collar 32.

From the above construction it is seen that the pin 23 and bushing 24 connection imparts rotational movement of the drive pulley 12 whenever the drive shaft 16 is caused to be operated, while at the same time permitting a degree of axial movement of such pulley 12 along the shaft 16 under control of the spring 28. Like rotational movement is imparted to the idler pulley 14 through the print band 10, which latter pulley has a like degree of movement along its support shaft 30 under control of the spring 34.

Figure 3:
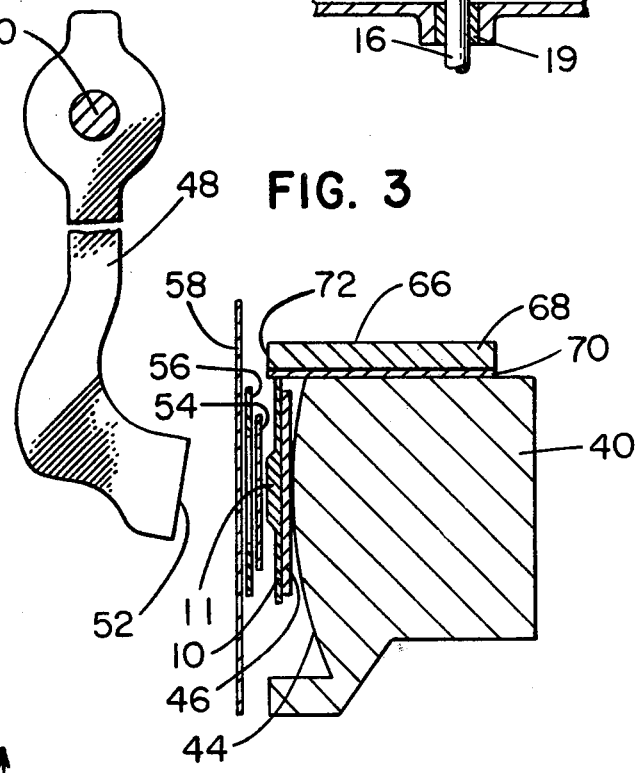
FIG. 3 is an enlarged sectional view taken along the line 3—3 of FIG. 2 and showing the relationship of the print hammer and various other printing elements.

A platen 40, shown in elevation in FIG. 2 and in sectional view in FIG. 3, is provided between the pulleys 12 and 14 (see also FIG. 1), thereby enabling an impact surface for the printing operation. The platen 40 (FIG. 3) has a curved surface 44 against which a bearing tape 46 is disposed to provide a minimum friction surface for the print band 10 while traveling therealong (FIG. 2). It is of course obvious that any suitable anti-friction type material may be employed in or on the tape 46. As seen in FIG. 3, the print band 10 includes type characters 11 thereon, the faces of which type characters extend from the print band 10 for impact by the print hammers provided. A plurality of print hammers 48 are shown in FIG. 1 for providing a single line of print, each of the print hammers 48 being carried on a common pivot 50 and adaptable to be swung from a no-printing position (FIG. 3) to a printing or impact position (FIG. 4) by suitable actuating means, not shown. The face 52 of each print hammer 48, as seen in FIG. 4, impacts against the type characters 11 on the print band 10 with certain intervening elements between the face 52 of the print hammer 48 and the print band 10, such elements per FIG. 3 commonly being a ribbon 54, an apertured shield 56 and record media or paper 58.

Figure 4:
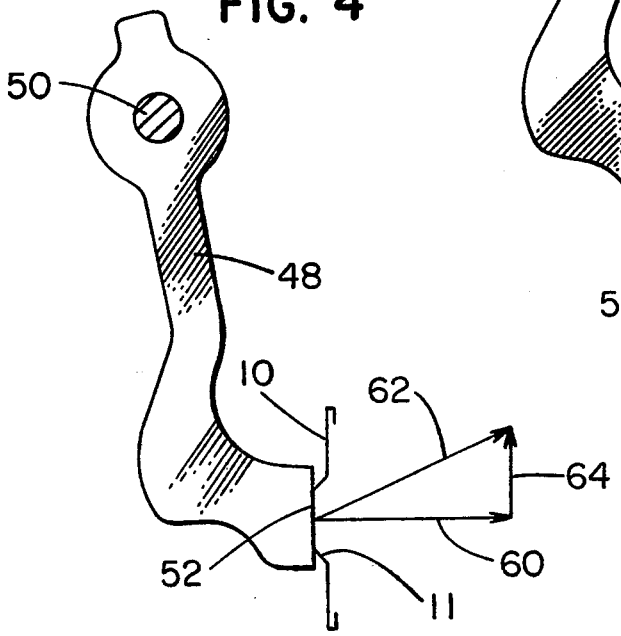
FIG. 4 is an operational showing of the print hammer of FIG. 3 with resultant forces upon impact of the print hammer against the print band.

As illustrated in FIG. 4, when each of the print hammers 48 is caused to be swung into contact with the paper 58 and against the ribbon 54 and the type characters 11 of the print band 10 there are two resulting forces, one being the print force shown by the line and arrow 60 and the other being a hammer force shown by the line and arrow 62. With the particular print hammer configuration and mounting as illustrated for the preferred embodiment of the invention, it is seen that the print force 60 is directed in a horizontal direction while the hammer force 62 is directed in an upwardly direction, which forces combine to make up a base and a hypotenuse of a triangle and define resultant force shown by the vertically upward directed line 64 which in effect transmits a lifting force to the print band 10.

In order to stop all vertical motion of the print band 10 while traveling past the printing station, especially that upward motion resulting from the lifting force transmitted by the print hammers 48, a top edge guide 66 made up of a flat metal top piece 68 and a lower bearing strip 70 extends along and is secured to the upper surface of the platen member 40 to provide a straight surface along which the upper edge of the print band 10 rides to maintain the band in a precise path along the printing line. As seen in FIG. 3, the bearing strip 70 is suitably affixed by epoxy or the like to the metal piece 68 and is likewise of anti-friction material to provide minimum drag on the print band 10 while traveling therealong. As further seen in FIG. 3, the preferred embodiment of the present invention makes use of an extremely thin (approximately 0.005 of an inch) print band 10 increasing approximately three fold (0.016 of an inch) in thickness at each type character 11 location. This requires the top edge guide 66 to be precise in its overhang of the platen 40 and have its front edge 72 preferably machined or otherwise squared to provide a lower sharp corner for engaging with the print band upper edge when, to prevent creasing or other unwanted happening to the record media 58, normal positioning of the print band 10 is such that the face surfaces of the type characters 11 thereon are aligned with or slightly ahead of the front edge 72 of such top edge guide 66. With such alignment, upon impact of the hammer 48 against the paper 58 such paper is permitted to be maintained in a straight position as it is moved past the printing station.

In operation, with the print band 10 removed from the printer, springs 28 and 34 yieldingly urge their respective pulleys 12 and 14 upwardly against the associated flywheel 22 and collar 32. During application of a print band 10 to the printer, such pulleys 12 and 14 are caused to be moved downwardly sufficiently whereby the band upper edge is presented under the lower front edge of the top guide 66. Thereafter, with the print band 10 properly positioned on the crowned portions of such pulleys 12 and 14, which takes place automatically upon initial operation of the printer, the force of the several springs 28 and 34 is such to insure between 50 and 100 grams of load between the band 10 and the upper guide 66. This load is sufficient to maintain the band upper edge in sliding contact with the guide 66 under all operating conditions of the printer—whether the tendency for print band 10 shifting is vertically upwardly as herein defined or vertically downwardly through employment of a different print hammer arrangement.

It is thus seen that herein shown and described is a print band top edge guide assembly which provides structure and function for maintaining the print band in a precise path along the line of printing. The print band is thereby restrained or caused to be driven in such path and the effect of the force of the print hammer thereagainst is constrained by the engagement of the print band with the top edge guide at all times during printer operation. The apparatus enables the accomplishment of the objects and advantages mentioned above and while only one embodiment of the invention has been disclosed herein, variations thereof may occur to those skilled in the art, especially in the areas of pulley mounting, spring biasing and print hammer arrangements. It is thus contemplated that all such variations not departing from the spirit and scope of the invention hereof, are to be construed in accordance with the following claims.

What is claimed is:

1. A guide assembly for maintaining the position of a print band in a band printer, said print band being trained around a drive pulley and an idler pulley and along a print line, said drive pulley and said idler pulley being floatably mounted in said band printer for movement normal to the length of said printing line, said band printer having a plurality of print hammers mounted for impact with the print band along said printing line, said assembly comprising:

a platen positioned along said printing line and having a surface slidably engaging a surface of said print band;

an elongated guide member extending along an edge of said platen adjacent to the region of said printing line, said guide member having a face extending along the region of said printing line and beyond the surface of said platen and the print band slidably engaged thereagainst; and bias means continually biasing said drive and idler pulleys, and the print band trained thereon, in a direction normal to the length of said printing line and toward said face of said guide member to maintain one edge of said print band in sliding engagement with the face of said guide member to retain said print band in precise position along the printing line during travel therealong.

2. The guide assembly according to claim 1 wherein said print hammers tend to produce an upwardly directed force to the print band upon impact therewith, said guide member being positioned along the top edge of said platen to engage the top edge of said print band, and said bias means continually biases said drive and idler pulleys in an upwardly direction to continually maintain the top edge of said print band in slidable engagement against the face of the guide member.

3. The guide assembly according to claim 2 wherein the face of said guide member includes a friction-reducing surface engaging the top edge of said print band.

4. The guide assembly according to claim 3 wherein said drive and idler pulleys are floatably mounted on individual shafts extending normal to the direction of said printing line and said bias means comprises first and second spring members supported by said shafts upwardly biasing said drive and idler pulleys, respectively.

5. The guide assembly according to claim 2 wherein said drive and idler pulleys are floatably mounted on individual shafts extending normal to the direction of said printing line and said bias means comprises first and second spring members supported by said shafts upwardly biasing said drive and idler pulleys, respectively.

6. The guide assembly according to claim 1 wherein the face of said guide member includes a friction-reducing surface engaging the edge of said print band.

7. In a printer having a printer band trained around a drive pulley and an idler pulley for movement along a horizontal printing line between said drive and idler pulleys, said drive pulley and said idler pulley being floatably mounted in said band printer for movement normal to the length of said printing line, a platen positioned along said printing line having a surface slidably engaging said print band, and hammer means swingably movable to impact with said print band and against said platen along said printing line, said hammer means tending to impart an upwardly directed force to the print band upon impact therewith, a guide assembly for maintaining the print band in precise upward position along said printing line comprising:

an elongated guide member extending along the top of said platen above the region of said printing line, said guide member having a face extending along the region of said printing line and beyond the surface of said platen and the print band slidably engaged thereagainst; and bias means continuously biasing said drive and idler pulleys, and the print band trained thereon, in an upward direction toward the face of said guide member to maintain the top edge of said print band in sliding engagement with the face of said guide member to retain said print band in a precise position along said printing line.

8. The guide assembly according to claim 7 wherein the face of said guide member includes a friction-reducing surface engaging the top edge of said print band.

9. The guide assembly according to claim 7 wherein said drive and idler pulleys are floatably mounted on individual shafts extending normal to the direction of said printing line and said bias means comprises first and second spring means supported by said shafts upwardly biasing said drive and idler pulley, respectively.

* * * * *